US005615442A

United States Patent [19]

Schroeck et al.

[11] Patent Number: 5,615,442

[45] Date of Patent: Apr. 1, 1997

[54] MOP INCLUDING MOP CONNECTOR

[75] Inventors: Harold J. Schroeck, West Chester; Paul R. Burger, Lebanon, both of Ohio

[73] Assignee: Vining Industries, Inc., Springfield, Ohio

[21] Appl. No.: 575,228

[22] Filed: Dec. 20, 1995

[51] Int. Cl.[6] ..... A47L 13/20

[52] U.S. Cl. ..... 15/147.1

[58] Field of Search ..... 15/147.1, 147.2, 15/151, 150, 120.1, 120.2, 119.1

[56] References Cited

U.S. PATENT DOCUMENTS

| | | | |
|---|---|---|---|
| 780,945 | 1/1905 | Fenton | 15/147.1 |
| 1,092,770 | 4/1914 | Humphries | 15/147.1 |
| 1,137,760 | 5/1915 | Kawasaki | 15/119.1 |
| 2,079,988 | 5/1937 | Cushman et al. | 15/147.1 |
| 2,201,732 | 5/1940 | Johnson | 15/147.1 |
| 3,145,406 | 8/1964 | Lay | 15/147.1 |
| 3,431,576 | 3/1969 | Moss et al. . | |
| 3,447,183 | 6/1969 | McClung et al. | 15/151 |
| 4,135,272 | 1/1979 | Stephenson | 15/147.1 |
| 4,227,277 | 10/1980 | McNelley, Jr. . | |
| 4,850,072 | 7/1989 | Smith | 15/147.1 |
| 5,375,286 | 12/1994 | Harrah | 15/147.1 |
| 5,509,163 | 4/1996 | Morad | 15/120.2 |

FOREIGN PATENT DOCUMENTS

| | | | |
|---|---|---|---|
| 445257 | 11/1949 | Italy | 15/147.1 |
| 1200824 | 8/1970 | United Kingdom | 15/147.1 |

*Primary Examiner*—Tony G. Soohoo
*Attorney, Agent, or Firm*—Biebel & French

[57] ABSTRACT

A wringer mop including a handle and a head portion having a plurality of mop strands, and an improved connector for connecting the mop strands to the handle. The connector includes a connector body having a collar portion and a hollow shank portion. A strand clip is provided for engaging with the mop strands and includes a pair of legs for extending into engagement with the shank portion whereby the strand clip is attached to the connector body. The mop is assembled by first engaging the mop strands with the strand clip and then connecting the strand clip to the connector body. Subsequently, the assembled connector body and strand clip may be attached to the bottom of the handle by inserting the shank portion into the handle.

12 Claims, 4 Drawing Sheets

MOP INCLUDING MOP CONNECTOR

BACKGROUND OF THE INVENTION

1. Field of the Invention

The present invention relates to a mop having a plurality of strands forming a mop head and, more particularly, to a wringer mop having an improved connector for the mop head to hold the mop strands.

2. Description of the Prior Art

In conventional wringer mops, as well as string-type or yacht-type mops, a head portion for the mop is formed from a plurality of strands, such as yarn strands. The strands are typically attached to the bottom of a mop handle by means of a strap which fastens to the end of the handle and through which the yarn strands pass. In several prior art mops, the strap for attaching the yarn strands to the bottom of the handle is simultaneously brought into engagement with the bottom of the handle while gathering the strands into position at the bottom of the handle. For example, U.S. Pat. No. 780,945 to Fenton discloses a mop including a strap-like retainer which is brought into engagement with an end of a mop handle to retain a plurality of strands on the mop handle.

U.S. Pat. No. 4,135,272 to Stephenson discloses a mop connector wherein one end of a strap for the connector is attached to a mop handle and a plurality of strands are brought into engagement with the strap whereupon a distal or free end of the strap is fastened to retain the strands on the handle.

In another known mop construction, a connector is mounted to the bottom of a mop handle and a medial portion of a plurality of strands is brought into association with the connector whereupon a pin is passed through the connector to retain the medial portion of the strands therein and thereby fasten the strands to the mop handle.

While the above-described mop constructions work effectively for their intended purpose, it is desirable to assemble mops wherein the strands may be gathered onto a connector prior to attachment to the mop handle. Further, there is a need for such a connector which facilitates placement of the strands in association with the connector.

SUMMARY OF THE INVENTION

The present invention provides a mop of the type including a plurality of strands, such as yarn strands for cleaning a floor. The mop includes an improved connector for connecting the strands to a handle for the mop.

The connector preferably includes a connector body for supporting the mop strands and a strand clip attached to the connector body and including a loop portion for receiving a plurality of the strands therethrough. The connector body includes a shank portion extending into the handle of the mop to thereby form a connection between the connector body and the mop handle.

The connector body further includes a collar portion defined by an enlarged end portion located at one end of the shank portion. The collar portion is adapted to receive the loop portion of the strand clip, and the strand clip further includes a pair of substantially parallel legs extending through the shank portion of the connector body. The legs maintain the strand clip in engagement with the connector body, and the legs each include a locking tab for engaging an end wall of the connector body shank portion to thereby lock the legs in position.

The present connector body permits the strands for the mop to be attached to the connector body prior to assembly to the mop handle. Thus, the connector body and mop strands may be assembled as a subunit for attachment to the mop handles and thus facilitate assembly of the mop.

Therefore, it is an object of the present invention to provide a mop having an improved connector for holding mop strands in engagement with a handle.

It is another object of the invention to provide such a mop wherein the connector and mop strands may be assembled as a subunit for attachment to a mop handle.

Other objects and advantages of the invention will be apparent from the following description, the accompanying drawings and the appended claims.

DETAILED DESCRIPTION OF THE PREFERRED EMBODIMENT

Figure 1:
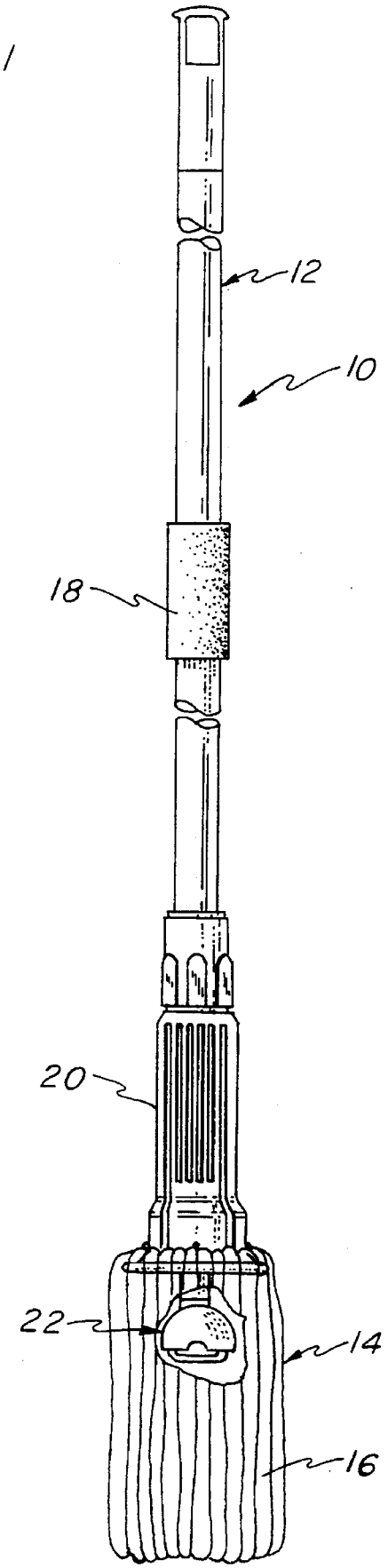
FIG. 1 is an elevational view of a mop partially cut away to show a connector of the present invention.

Referring initially to FIG. 1, the present invention is directed toward a mop 10 including a handle 12 and a head portion 14 comprising a plurality of mop strands 16. A padded hand grip 18 may be provided along the handle 12 and a sleeve 20 is mounted for sliding movement along the handle and is attached to a portion of the strands 16 whereby sliding and twisting movement of the sleeve 20 may be performed to wring out fluids from the strands 16 in a conventional manner. In addition, a mop connector 22 is provided attached at a lower end of the handle 12 and connected to the strands 16 to further connect the strands 16 to the handle 12.

Figure 2:
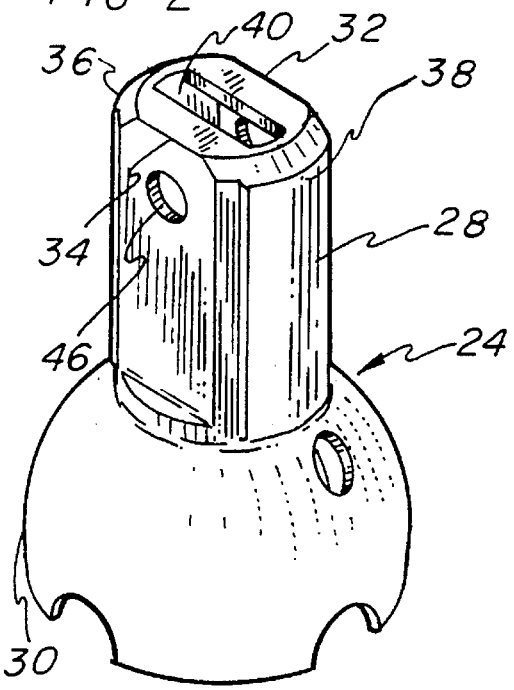
FIG. 2 is a perspective view of a connector body for a connector of the mop.
Figure 4:
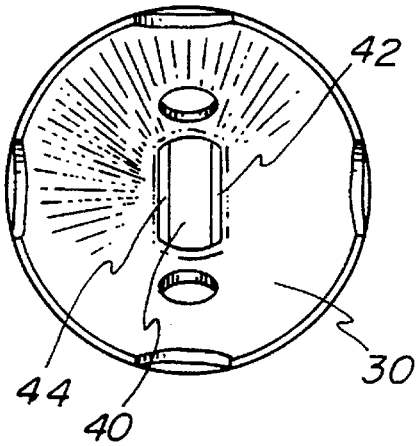
FIG. 4 is a bottom plan view of the connector body of FIG. 2.
Figure 3:
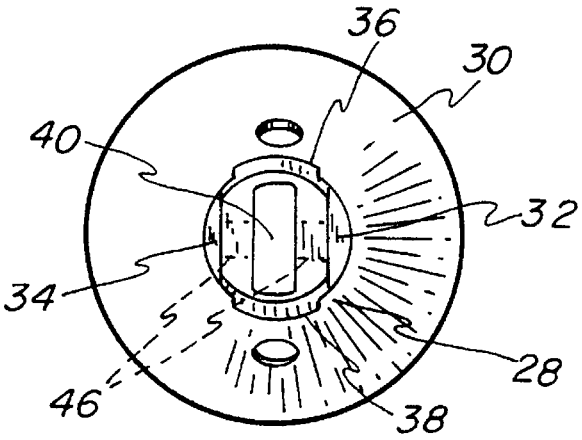
FIG. 3 is a top plan view of the connector body of FIG. 2.
Figure 8:
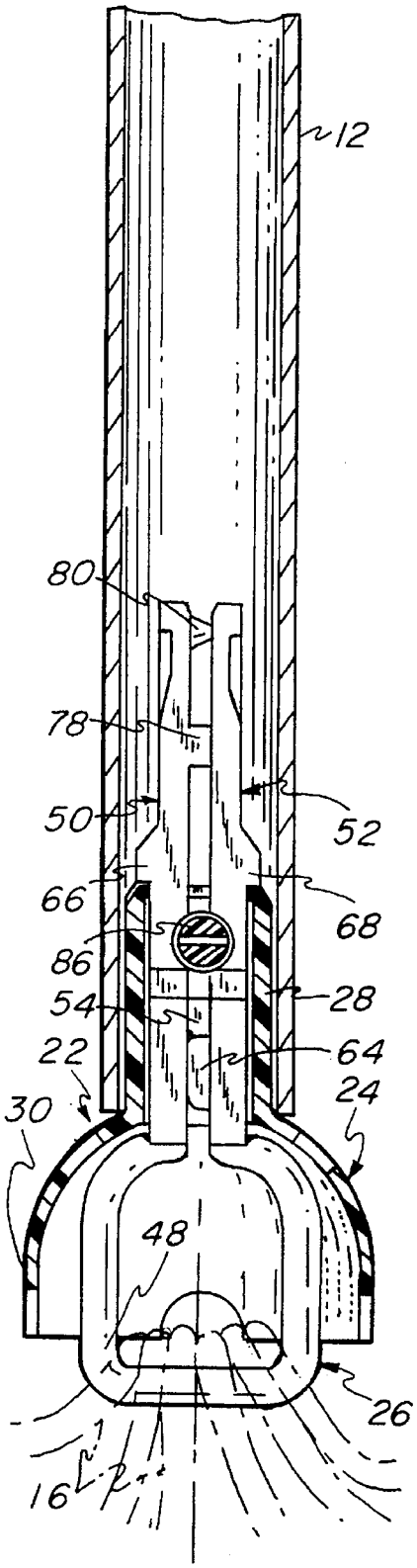
FIG. 8 is a fragmentary cross-sectional view illustrating the assembled mop connector of the present invention.

As may be seen in FIG. 8, the mop connector 22 comprises a connector body 24 and a strand clip 26 positioned within the connector body 24 wherein both the connector body 24 and clip 26 are preferably formed of plastic. Referring further to FIGS. 2–4, the connector body 24 includes a hollow shank portion 28 and a collar portion 30 defining an enlarged dome shaped end at one end of the shank portion 28. The shank portion 28 has a substantially rectangular configuration including a pair of parallel side walls 32, 34 and connecting end walls 36, 38 which are provided with curved exterior surfaces adapted to match and cooperate with the interior surface of a hollow mop handle 12. The walls 32, 34, 36, 38 define a rectangular aperture 40 extending through the shank portion 28.

The shank portion 28 further includes an upper end wall or engagement surface defined by ends of the walls 32, 34, 36, 38 and by end wall portions 42, 44 extending inwardly from the side walls 32, 34, respectively. In addition, a through aperture 46 is defined extending through the side walls 32, 34 for receiving a pin to mount the connector body 24 to the handle 12, as will be described further below.

Figure 7:
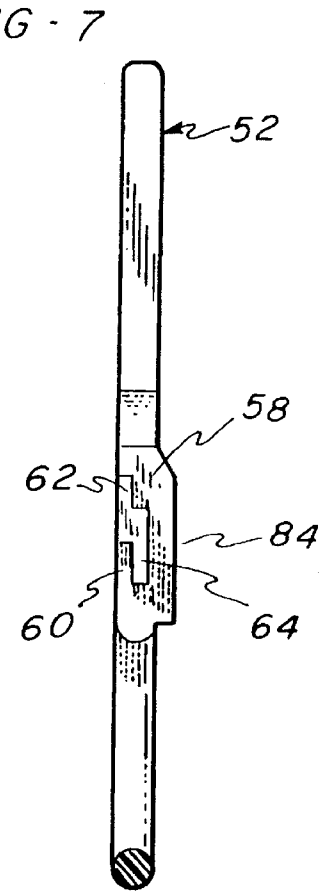
FIG. 7 is an elevational view taken along line 7—7 in FIG. 5.
Figure 6:
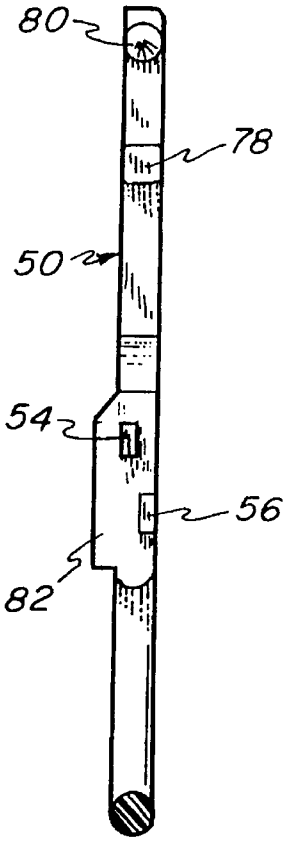
FIG. 6 is an elevational view taken along line 6—6 in FIG. 5.
Figure 5:
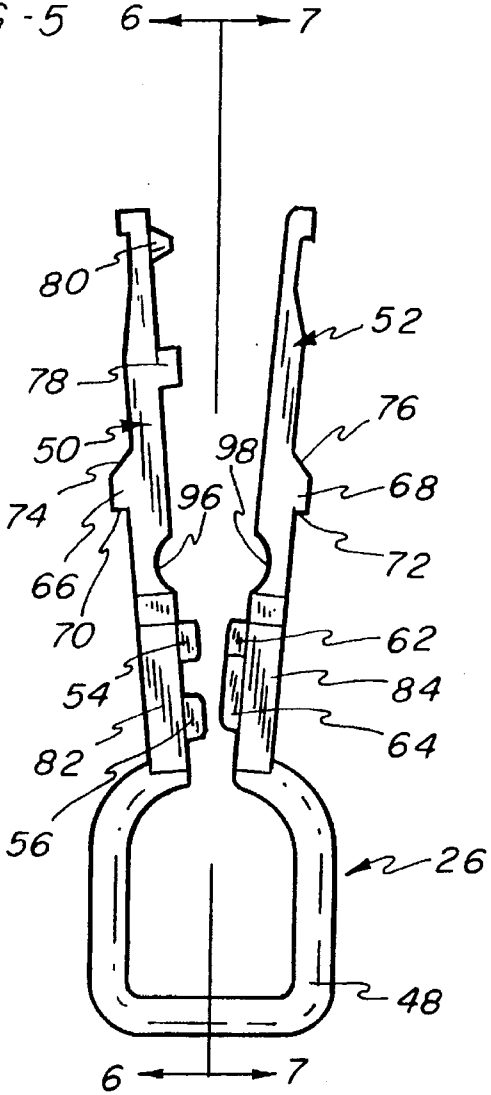
FIG. 5 is a side elevational view of a strand clip for a connector of the mop.

Referring to FIGS. 5–7, the strand clip 26 comprises a generally U-shaped loop portion 48 for receiving the mop strands 16 therethrough, and a pair of substantially straight legs 50, 52 extending from ends of the loop portion 48. The strand clip 26 is preferably formed as an integral flexible plastic piece wherein the legs 50, 52 are adapted to be positioned in parallel alignment with each other. In order to facilitate alignment of the legs 50, 52 with each other, the leg 50 is provided with a pair of alignment tabs 54, 56, and a pair of alignment slots 58, 60 are defined in the other leg by alignment projections 62, 64 for receiving and cooperating with the alignment tabs 54, 56.

Each leg 50, 52 is further provided with a locking tab 66, 68 having respective laterally extending locking surfaces 70, 72 and tapered guide surfaces 74, 76. The legs 50, 52 are adapted to be inserted through the aperture 40 in the shank 28, and the guide surfaces 74, 76 guide the legs inwardly for passage past the collar portion 30 and into the shank portion 28. The locking surfaces 70, 72 are configured to engage the end wall of the shank portion 28 to prevent the legs 50, 52 from being withdrawn from the connector body 24.

One of the legs 50 is provided with a spacer tab 78 located on an interior surface of the leg 50 for engaging an interior surface of the opposing leg 52. The spacer tab biases the legs 50, 52 to a spaced apart position when the legs 50, 52 are engaged within the aperture 40 to thereby ensure that the locking surfaces 70, 72 remain in position extending over the end wall of the shank portion 28. A further spacer protrusion 80 may be provided adjacent to an end of one of the legs 50 for further ensuring that the end portions of the legs 50, 52 are maintained in spaced relation.

It should be noted that each of the legs 50, 52 includes a shim portion 82, 84 (FIGS. 6, 7) for cooperating with the interior surface of either side wall 32, 34 adjacent to the collar portion end of the shank 28 to thereby limit sideways movement of the strand clip 26 within the aperture 40.

Figure 9:
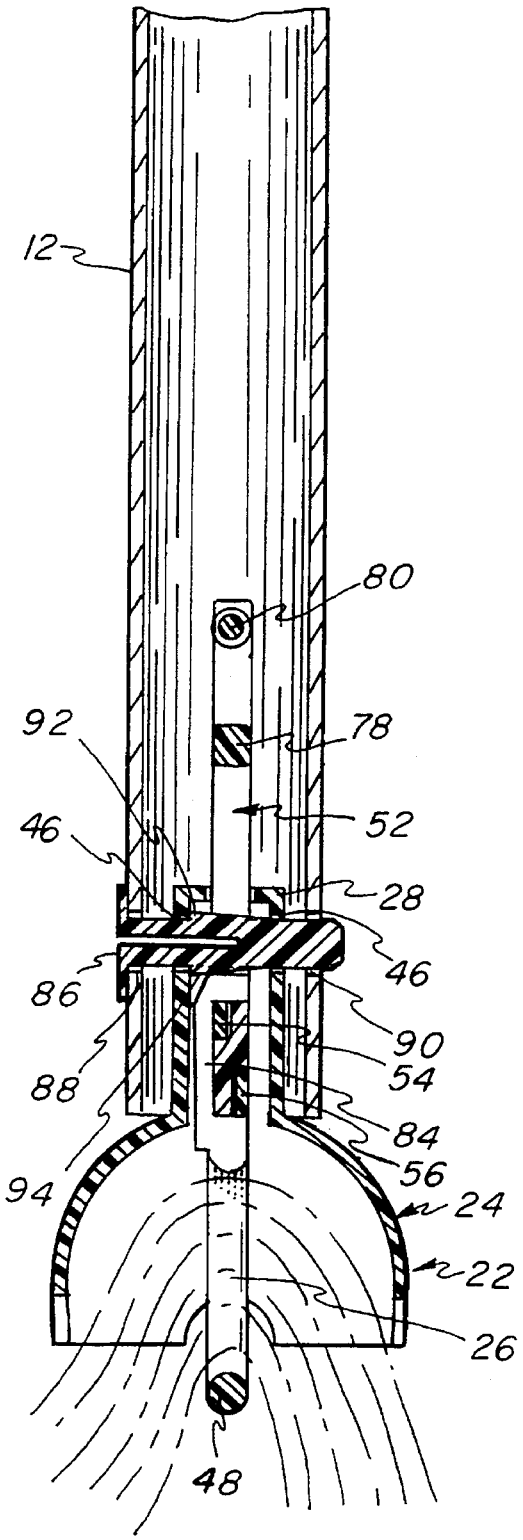
FIG. 9 is a fragmentary cross sectional view illustrating the assembled mop connector, and taken perpendicular to the view of FIG. 8.

Referring to FIGS. 8 and 9, the mop connector 22 is initially assembled prior to attachment to the handle 12. During assembly, the mop strands 16 are initially engaged by the loop portion 48 of the strand clip 26, and the legs 50, 52 of the strand clip are then inserted through the connector body 24 into engagement with the shank portion 28 such that the loop portion 48 is received within the enlarged collar portion 30.

The assembled connector is then inserted into the bottom end of the handle 12 and a locking pin 86 is positioned through apertures 88, 90 in the handle 12 and extending through the aperture 46 in the shank portion 28 to thereby lock the connector 22 to the handle 12. The pin 86 includes outwardly extending barb portions 92, 94 for engaging one of the side walls 32, 34 to prevent removal of the pin 86.

It should be noted that the legs 50, 52 of the strand clip 26 are each provided with a respective semi-circular groove 96, 98 (FIG. 5) which define a passage aligned with the aperture 46 to permit passage of the pin 86 through the legs 50, 52.

From the above description, it should be apparent that the present invention provides a mop including an improved mop connector which facilitates assembly of the mop strands to the mop.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A mop including a hollow handle and a head portion having a plurality of mop strands, the improvement comprising:

a connector body including an elongated shank portion extending into said handle and defining an aperture extending through a central portion of said connector body, said shank portion including an upper end wall located within said handle;

a strand clip attached to said connector body, said strand clip including a loop portion for receiving a plurality of the mop strands therethrough, said strand clip further including a pair of legs extending from said loop portion and inserted into the aperture in said shank portion; and wherein said legs include locking tabs extending outwardly from said legs, said legs biasing said locking tabs outwardly into a position engaging said upper end wall in response to insertion of said legs through said aperture in said shank portion.

2. The mop as recited in claim 1 wherein inner portions of said legs are located in engagement with each other to position said locking tabs outwardly over said upper end wall.

3. The mop as recited in claim 1 wherein said connector body includes a collar portion connected to said shank portion, and said loop portion of said strand clip is located within said collar portion.

4. A mop including a hollow handle and a head portion having a plurality of mop strands, the improvement comprising:

a connector body including a shank portion extending into the handle;

a strand clip attached to said connector body, said strand clip including a loop portion for receiving a plurality of the mop strands therethrough, said strand clip further including a pair of legs extending from said loop portion and attached to said shank portion;

said shank portion including an upper end wall and said legs including outwardly extending locking tabs for engaging said upper end wall to maintain said strand clip in engagement with said connector body; and including a spacer tab located on an inner portion of one of said legs for engaging the other of said legs whereby said legs are biased apart over said upper end wall.

5. A mop including a hollow handle and a head portion having a plurality of mop strands, the improvement comprising:

a connector body including a collar portion and an elongated shank portion extending into said handle and defining an aperture extending through a central portion of said connector body, said shank portion including an upper end wall;

a strand clip including a U-shaped loop engaged with the mop strands and a pair of substantially straight legs extending from said U-shaped loop, said legs extending into said aperture in said shank portion;

said collar portion defining an enlarged end portion of said connector body for receiving said U-shaped loop; and wherein said legs include locking tabs extending outwardly from said legs, said legs biasing said locking tabs outwardly into a position engaging said upper end wall in response to insertion of said legs through said aperture in said shanks portion.

6. The mop as recited in claim 5 wherein said U-shaped loop engages and positions the yarn strands within said collar.

7. The mop as recited in claim 5 wherein said locking tabs include a tapered surface to facilitate insertion of said legs through said shank portion.

8. The mop as recited in claim 5 including means defining a laterally extending aperture through said shank portion and a pin extending through the handle and through said laterally extending aperture to retain said connector body on the handle.

9. A mop connector for use with a mop having a handle and a head portion formed of a plurality of strands, said connector comprising:

a connector body including a collar portion and an elongated shank portion defining an aperture extending through a central portion of said connector body, said shank portion including an engagement surface;

a strand clip including a loop portion for engaging with the mop strands and a pair of legs extending from said loop portion through said aperture in said shank portion;

said collar portion including an end for receiving said loop portion; and wherein said legs include laterally extending surfaces formed at side edges of said legs for engaging said engagement surface of said shank portion, said legs biasing said laterally extending surfaces outwardly into engagement with said engagement surface in response to insertion of said legs through said aperture in said shank portion.

10. The mop connector as recited in claim 9 wherein said collar portion includes an enlarged end for receiving said loop portion.

11. The mop connector as recited in claim 9 wherein said laterally extending surfaces comprise locking tabs extending outwardly from said legs for engaging said engagement surface whereby said strand clip is maintained in engagement with said connector body.

12. The mop connector as recited in claim 11 including a spacer tab located on one of said legs for engaging the other of said legs whereby said legs are biased apart and said locking tabs are biased radially outwardly.

* * * * *